US007881651B2

(12) United States Patent
Watanabe

(10) Patent No.: US 7,881,651 B2
(45) Date of Patent: Feb. 1, 2011

(54) LUBRICANT APPLYING DEVICE AND IMAGE FORMING APPARATUS

(75) Inventor: Sho Watanabe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/540,503

(22) Filed: Aug. 13, 2009

(65) Prior Publication Data

US 2010/0202812 A1 Aug. 12, 2010

(30) Foreign Application Priority Data

Feb. 6, 2009 (JP) ..... 2009-025987

(51) Int. Cl.
*G03G 21/00* (2006.01)

(52) U.S. Cl. ..... 399/346; 399/123; 184/17

(58) Field of Classification Search ..... 399/71, 399/123, 343, 346; 15/256.51, 256.52; 184/14, 184/17, 99

See application file for complete search history.

(56) References Cited

U.S. PATENT DOCUMENTS 6,160,977 A * 12/2000 Takeichi et al. ..... 399/127
6,295,438 B1 * 9/2001 Fujishiro et al. ..... 399/346
6,363,237 B1 * 3/2002 Nagame et al. ..... 399/343

FOREIGN PATENT DOCUMENTS

| | | |
|---|---|---|
| JP | 2001-235987 | 8/2001 |
| JP | 2004-177811 | 6/2004 |
| JP | 2007-187845 | 7/2007 |
| JP | 2007-212979 | 8/2007 |

* cited by examiner

*Primary Examiner*—David P Porta
*Assistant Examiner*—Benjamin Schmitt
(74) *Attorney, Agent, or Firm*—Fildes & Outland, P.C.

(57) ABSTRACT

A lubricant applying device, includes: an image carrier; a lubricant; a lubricant applying member that contacts the image carrier and the lubricant, and maintains a portion of the lubricant on an outer periphery of the lubricant applying member due to rotating so as to apply the lubricant to the image carrier; and a solid material that is adjacently provided with the lubricant on an upstream side in a rotation direction of the lubricant applying member, wherein the solid material has a higher level of hardness than the lubricant and is worn out due to contact with the lubricant applying member.

8 Claims, 4 Drawing Sheets

LUBRICANT APPLYING DEVICE AND IMAGE FORMING APPARATUS

CROSS-REFERENCE TO RELATED APPLICATION

This application is based on and claims priority under 35 USC 119 from Japanese Patent Application No. 2009-025987 filed Feb. 6, 2009.

BACKGROUND

1. Technical Field

The present invention relates to an image forming apparatus using xerography, and more particularly, to a device for applying a lubricant to an image carrier (a photosensitive member or an intermediate transfer member) in an image forming apparatus.

2. Related Art

In an image forming apparatus using xerography, a photosensitive member uniformly charged is irradiated with light in order to form a latent image pattern, and toner is supplied to the photosensitive member by a developing unit to form a toner image. The toner image is transferred and fixed to a printing medium, and the remaining toner on the surface of the photosensitive member is recovered by a cleaning unit.

As a cleaning method, a scraping method of allowing a cleaning blade to contact the photosensitive member has been widely used for the reasons of simplicity of structure and low costs. When friction between the cleaning blade and the photosensitive member is high, it causes wear on the blade and the photosensitive member, resulting in a reduction of in the life span thereof.

SUMMARY

According to an aspect of the invention, there is provided a lubricant applying device, including:

an image carrier;

a lubricant;

a lubricant applying member that contacts the image carrier and the lubricant, and maintains a portion of the lubricant on an outer periphery of the lubricant applying member due to rotating so as to apply the lubricant to the image carrier; and a solid material that is adjacently provided with the lubricant on an upstream side in a rotation direction of the lubricant applying member, wherein the solid material has a higher level of hardness than the lubricant and is worn out due to contact with the lubricant applying member.

BRIEF DESCRIPTION OF THE DRAWING

Exemplary embodiments of the present invention will be described in detail based on the following figures, wherein.

DETAILED DESCRIPTION

Hereinafter, exemplary embodiments of a lubricant applying device of the invention and an image forming apparatus using the lubricant applying device will be described in detail with reference to the accompanying drawings.

Configuration of Common Part of the Related Art and the Invention

Figure 1:
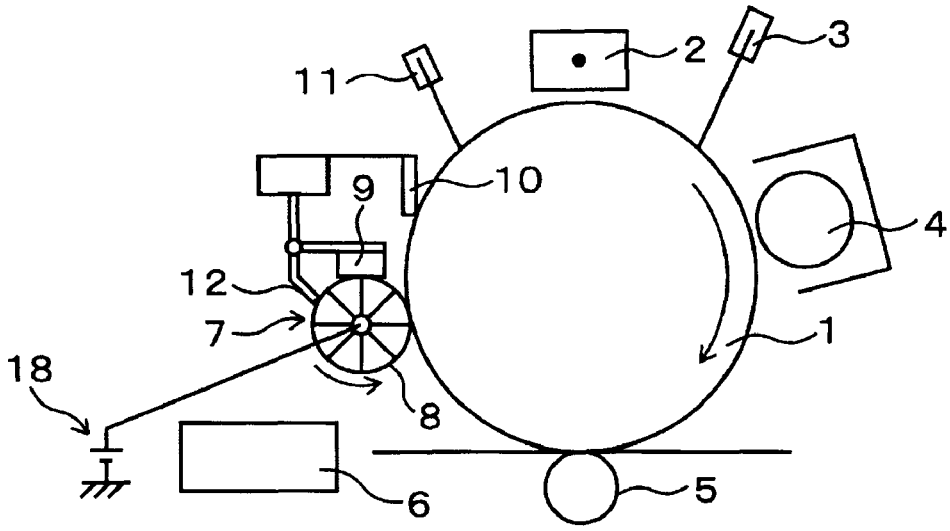
FIG. 1 represents a conceptual view illustrating the configuration of the main part of an image forming apparatus according to the invention and the related art.

FIG. 1 is a view illustrating the configuration of the main part of an image forming apparatus for which a lubricant applying device can be used, according to an exemplary embodiment. In the image forming apparatus illustrated in FIG. 1, reference numeral 1 denotes a photosensitive member (image carrier) 1 which has at least a cylindrical shape which is able to be rotated, and a charging device 2 which is provided so as to be close to the photosensitive member 1 and uniformly charges the surface of the photosensitive member 1. On the downstream side of the charging device 2 in the rotation direction of the photosensitive member, an exposure device 3 is provided for irradiating the photosensitive member 1 with light to form a latent image pattern. On the downstream side of the exposure device 3, a development device 4 is provided for supplying a developer such as toner to the photosensitive member 1 to form a toner image. On the downstream side of the development device 4, a transfer device 5 is provided for transferring the toner image on a printing medium. On the downstream side of the transfer device 5, a fixing device 6 is provided for fixing the toner image on the printing medium. On the downstream side of the fixing device 6, a lubricant applying device 7 is provided for supplying a lubricant to the photosensitive member 1. On the downstream side of the lubricant applying device 7, a cleaning blade 10 is provided for cleaning the remaining toner from the photosensitive member 1. On the downstream side of the cleaning blade 10, a static eliminator 11 is provided for removing charges from the photosensitive member 1.

The lubricant applying device 7 of the image forming apparatus of FIG. 1 will be described. The lubricant applying device 7 includes a brush roller 8 (lubricant applying member) which contacts the photosensitive member 1 on the downstream side of the transfer device 5 to be rotated in the direction of the arrow, and a solid lubricant 9 which is in contact with the brush roller 8. The solid lubricant 9 comes in pressing contact with the brush roller 8 only under the pressure of its own weight or in combination with an auxiliary unit such as a spring. As the brush roller 8 is rotated, the solid lubricant 9 is scrapped off and held on the brush roller 8, and the lubricant is then supplied and applied to the photosensitive member 1. In addition, in this exemplary embodiment, the brush roller 8 is used as the lubricant applying member. However, any member such as a rotatable elastic member can be employed as long as the member is in contact with and scraps off the solid lubricant 9. On the downstream of the solid lubricant 9, a flicker 12 is provided for adjusting the amount of the lubricant or toner attached to the surface of the brush roller 8. A power supply 18 applies AC bias or DC bias to the brush roller 8 for accelerating the application of the lubricant to the photosensitive member 1.

In the above description, the photosensitive member 1 is employed as an example of the image carrier to which the solid lubricant is to be applied. However, this can also be applied in the case where the image carrier is an intermediate transfer belt or the like. In addition, there is an image forming apparatus including only the photosensitive member as the image carrier, or an image forming apparatus including both the photosensitive member and the intermediate transfer member. However, the invention can be applied to any image forming apparatus.

In addition, among the components used for the image forming apparatus, in addition to the lubricant applying device 7 of the invention, well-known techniques used in xerography can be employed by the photosensitive member 1, the charging device 2, the exposure device 3, the development device 4, the transfer device 5, the fixing device 6, the cleaning blade 10, the static eliminator 11 and the like.

Figure 2A:
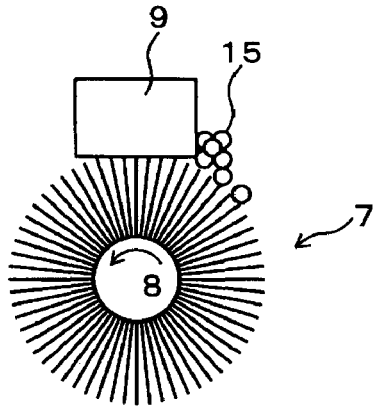
FIG. 2A Related Art
FIGS. 2A and 2B are enlarged views illustrating a lubricant applying device of the image forming apparatus according to the related art.
Figure 2B:
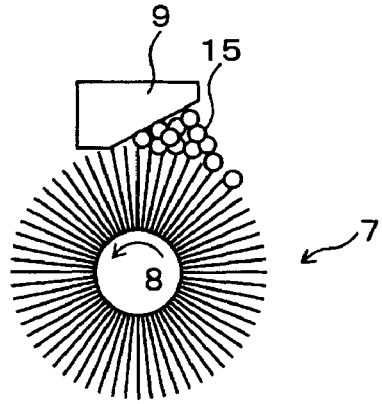
FIG. 2B Related Art

Here, a lubricant applying device according to the related art, which does not use the invention, will be described as a comparative example. FIG. 2A illustrates an initial state of a lubricant applying device according to the related art. The remaining toner from the photosensitive member is transported to the vicinity of the solid lubricant 9 by the rotation of the brush roller 8. Since the brush roller 8 and the solid lubricant 9 come in close contact with each other, the remaining toner is accumulated on the upstream side of the solid lubricant 9. Then, a toner accumulation 15 is formed on the upstream side of the solid lubricant 9. The upstream side of the solid lubricant 9 contacts the rolled toner accumulation 15 in addition to the brush roller 8, so that wear thereof becomes significant in comparison to the downstream side. As a result, as illustrated in FIG. 2B, the amount of the solid lubricant 9 worn out on the upstream side becomes excessive.

Figure 3A:
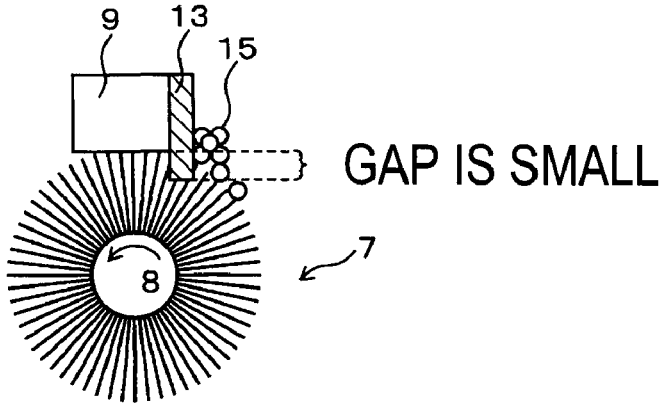
FIG. 3A Related Art
FIGS. 3A and 3B are enlarged views illustrating a lubricant applying device of the image forming apparatus according to the related art.
Figure 3B:
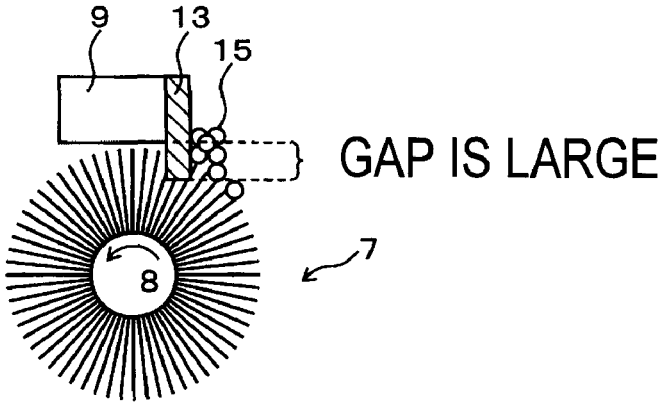
FIG. 3B Related Art

FIG. 3A illustrates an initial state of another lubricant applying device according to the related art for solving the above-mentioned problem. On the upstream side of the solid lubricant 9, a flicker 13 made of a wear-resistive material is provided to scrape the toner accumulation 15 from the brush roller 8. With such a configuration, contact between the toner accumulation 15 and the solid lubricant 9 can be avoided. However, since the flicker 13 does not wear out, only the solid lubricant 9 is scrapped off, there is a gap between the solid lubricant 9 and the flicker 13 in a depth direction, and the gap increases with time. Here, originally, the position of the solid lubricant 9 is lowered under the pressure of its own weight to maintain a contact state as the solid lubricant 9 is worn out. However, in this lubricant applying device, the flicker 13 does not wear out but cuts into the brush roller 8. Accordingly, as illustrated in FIG. 3B, the brush roller 8 and the solid lubricant 9 gradually separate, and the supplied amount of the lubricant is reduced.

First Exemplary Embodiment

Figure 4A:
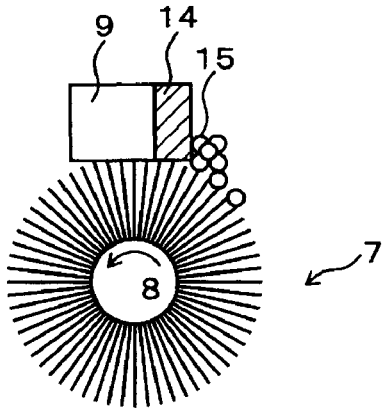
FIGS. 4A and 4B are enlarged views illustrating an exemplary example of a lubricant applying device according to an aspect of the invention.
Figure 4B:
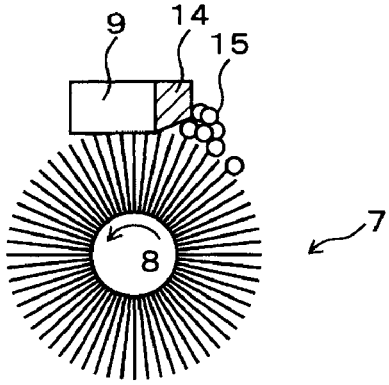

FIGS. 4A and 4B are enlarged schematic views illustrating a lubricant applying device 7 according to a first exemplary embodiment of the invention. In this exemplary embodiment, as illustrated as an initial state in FIG. 4A, the solid lubricant 9 is provided with a solid material 14 on the upstream side in the rotation direction of the brush roller 8, and the solid material 14 has a higher level of hardness than the solid lubricant 9 and is worn out due to contact friction with the brush roller 8.

According to the invention, similarly to the related art, when the solid lubricant is supplied and applied by the rotation of the brush roller 8, a toner accumulation 15 is formed between the brush roller 8 and the solid lubricant 9, and comes in contact with the solid lubricant 9 on the upstream side. This causes an increase in an amount of the solid lubricant 9 being worn out on the upstream side in the configuration according to the related art. However, in the configuration of this exemplary embodiment, due to the configuration in which the solid material 14 is provided on the upstream side and has a higher level of hardness than the solid lubricant 9, as illustrated in FIG. 4B, wear by the toner accumulation 15 is suppressed over time, so that it is possible to suppress excessive consumption of the solid lubricant 9.

As described above, in order to provide the solid lubricant with the solid material that has a higher level of hardness than the solid lubricant, any method may be employed for preparing a solid material for use and stacking the solid lubricant and the solid material to be integrated. In the first exemplary embodiment, the solid lubricant 9 is configured to have a double-layer structure. However, the configuration of the lubricant applying device 7 is not limited to the double-layer structure illustrated in FIGS. 4A and 4B, and a three-layer structure including an upstream layer, an intermediate layer, and a downstream layer, or a stacked structure having more layers may be employed.

In addition, a hardness distribution may be given to the solid material 14 provided to the solid lubricant 9 such that the hardness continuously decreases from the upstream side to the downstream side in the rotation direction of the brush roller 8. In order to allow the continuous hardness distribution, a method can be considered for using a cooling rate distribution which involves the cooling of the solid material to change them from a liquid state to a solid state.

Second Exemplary Embodiment

Figure 5A:
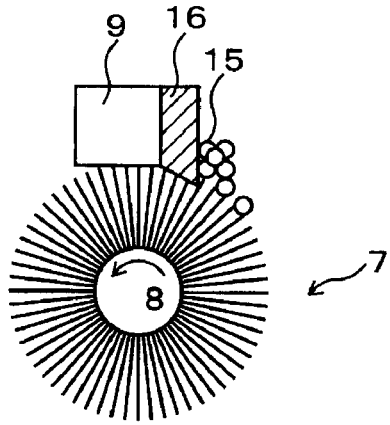
FIGS. 5A and 5B are enlarged views illustrating another exemplary example of the lubricant applying device according to an aspect of the invention.
Figure 5B:
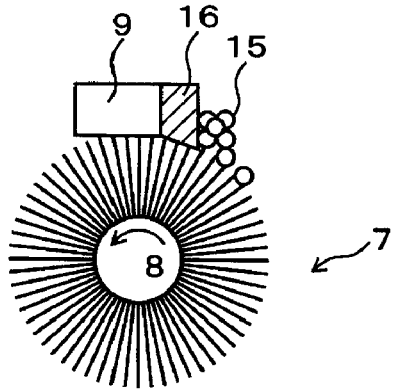

FIGS. 5A and 5B are enlarged schematic views illustrating a lubricant applying device 7 according to a second exemplary embodiment of the invention. In this exemplary embodiment, the shape of the solid material 14 is changed from that of the first exemplary embodiment so that it is a solid material 16 with a lower portion that has a shape corresponding to the contact surface of the brush roller 8.

With such a configuration, in comparison to the first exemplary embodiment, the gap between the brush roller 8 and the solid material 16 is reduced, and contact between the brush roller 8 and the solid lubricant 9 can be improved. Accordingly, the space into which the toner accumulation 15 is inserted is narrowed, and as a result, an increase in the amount of the solid lubricant worn out due to the toner accumulation can be suppressed.

In FIGS. 5A and 5B, the contact surface of the solid material 16 contacting the brush roller 8 has a plane shape. However, the shape of the solid material 16 is not limited, and may also be configured as a curved surface having substantially the same curvature as that of the outer peripheral surface of the brush roller 8.

Third Exemplary Embodiment

Figure 6A:
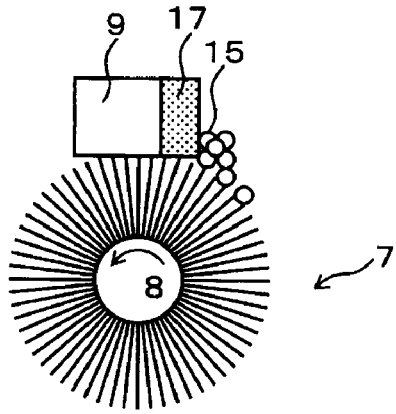
FIGS. 6A and 6B are enlarged views illustrating another exemplary example of the lubricant applying device according to an aspect of the invention.
Figure 6B:
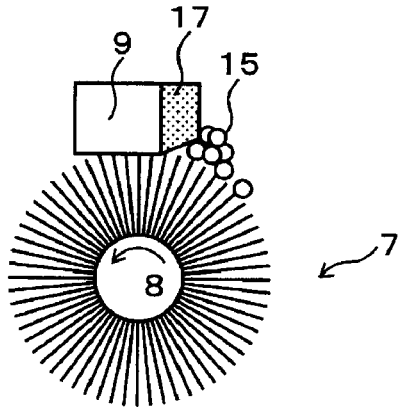

FIGS. 6A and 6B are enlarged schematic views illustrating a lubricant applying device 7 according to a third exemplary embodiment of the invention. In this exemplary embodiment, instead of the solid material 14 of the first exemplary embodiment, a solid lubricant 17 is used which has a higher level of hardness than the solid lubricant 9 and can be worn out.

With such as configuration, in comparison to the first exemplary embodiment, the solid material functions as a lubricant after being scrapped off by the brush roller 8 in addition to having a function of suppressing the intrusion of the tonner accumulation 15.

In order to allow the double-layer structure including the solid lubricant 9 and the solid lubricant 17 described above, a method of preparing and stacking plural lubricants with different levels of hardness so that they are integrated into a whole, or the like may be employed. In addition, as in the first exemplary embodiment, the configuration of the lubricant applying device 7 is not limited to the double-layer structure shown in FIGS. 6A and 6B, and a three-layer structure including an upstream layer, an intermediate layer, and a downstream layer, or a stacked structure having more layers may be employed. For the plural different lubricants described above, for example, zinc stearate, calcium stearate, and the like may be selected from fatty acid soaps. In addition, a plural-layer structure including the same material having different levels of hardness, which is obtained by changing the cooling rate when lubricants are cooled to be solidified, may be employed.

In addition, a configuration in which the hardness of the solid lubricant 9 is continuously decreased in the direction from the upstream side to the downstream side in the rotation direction of the brush roller 8 by giving a hardness distribution to the solid lubricant 9 may be employed. In order to allow for the continuous hardness distribution, a method of allowing a liquid lubricant to be given a cooling rate distribution or the like can be considered.

Example of Image Forming Apparatus

Figure 7:
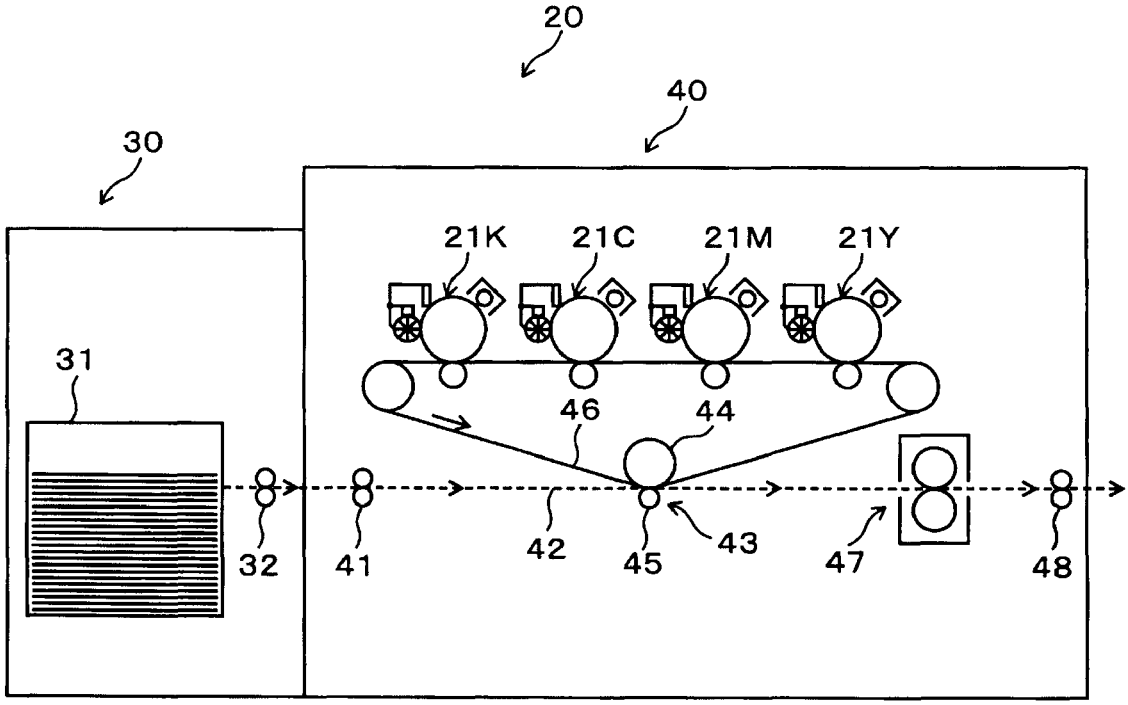
FIG. 7 is a conceptual view illustrating an exemplary example of the image forming apparatus according to an aspect of the invention.

An example of an image forming apparatus having the lubricant applying device illustrated in FIGS. 4A to 6B will be described. FIG. 7 is a conceptual view illustrating an example of the image forming apparatus according to the invention. In FIG. 7, an image forming apparatus 20 is shown. The image forming apparatus 20 has an image forming unit 40 including a sheet feeding unit 30 for feeding a sheet and an image forming unit 40 with image forming units 21Y, 21M, 21C, and 21K.

The sheet feeding unit 30 includes a storage part 31 for storing plural sheets, a mechanism not shown for transporting a sheet from the storage part 31 to the right of the figure, and a transport roller 32 for transporting the sheet transported from the mechanism to the right of the figure.

The image forming unit 40 includes a transport roller 41 for transporting the sheet transported from the sheet feeding unit 30 toward a secondary transfer unit 43 of the image forming unit 40 on a transport path 42. The secondary transfer unit 43 includes a transfer roller 44 and a counter roller 45, with a transfer belt 46 and the sheet are inserted therebetween to transfer a toner image formed on the transfer belt 46 to the sheet. A fixing device 47 is disposed on the downstream side of the secondary transfer unit 43. An exit roller 48, for outputting the sheet from the apparatus, is disposed on the downstream side of the fixing device 47.

Each of the image forming units 21Y to 21K includes the photosensitive member 1, the charging device 2, the exposure device 3, the development device 4, the transfer device 5, the fixing device 6, the cleaning blade 10, the static eliminator 11 illustrated in FIG. 1, and the lubricant applying device 7 illustrated in any one of FIGS. 4A to 6B. The image forming units 21Y to 21K form toner images of Y (yellow), M (magenta), C (cyan), and K (black) and perform the primary transfer of the toner images on the rotating transfer belt 46. Accordingly, the toner images of YMCK are overlapped such that a color toner image is formed on the transfer belt 46.

Hereinafter, an example of an operation of the forming an image on a sheet stored in the storage part 31 will be described. First, a sheet stored in the storage part 31 is transported to the right of the figure by the transport roller 32 and sent from the sheet feeding unit 30 to the image forming unit 40. The sheet sent to the image forming unit 40 is transported to the right of the figure on the transport path 42 and sent to the secondary transfer unit 43.

In line with the above timing, by the operation of the image forming units 21Y to 21K, the toner images of YMCK are overlapped on the transfer belt 46 to form a color toner image. The color toner image formed on the transfer belt 46 is transferred to the sheet in the secondary transfer unit 43. The color toner image transferred on the sheet in a state of not yet being fixed is fixed on the sheet by the fixing device 47. The sheet on which the image fixing process is performed is output from the apparatus by the operation of the exit roller 48.

In this example, in each of the image forming units 21Y to 21K, even when the remaining toner, which is on the photosensitive member after primary transfer is completed, is moved to the brush roller and forms a toner accumulation on the upstream side of the solid lubricant, excessive wear on the solid lubricant can be suppressed as a solid material (solid lubricant) is provided that has a higher level of hardness than the solid lubricant and can be worn out.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A lubricant applying device, comprising:

an image carrier;

a lubricant;

a lubricant applying member that contacts the image carrier and the lubricant, and maintains a portion of the lubricant on an outer periphery of the lubricant applying member due to rotating so as to apply the lubricant to the image carrier; and a solid material that is adjacently provided with the lubricant on an upstream side in a rotation direction of the lubricant applying member, wherein the solid material has a higher level of hardness than the lubricant and is worn out due to contact with the lubricant applying member.

2. The lubricant applying device according to claim 1, wherein the lubricant is a solid lubricant.

3. The lubricant applying device according to claim 1, wherein the solid material has a plurality of layers.

4. The lubricant applying device according to claim 1, wherein the solid material has a hardness distribution such that the hardness of the solid material continuously decreases from the upstream side to the downstream side in the rotation direction of the lubricant applying member.

5. The lubricant applying device according to claim 1, wherein the lubricant applying member is a brush roller.

6. The lubricant applying device according to claim 1, wherein a contact surface of the solid material with the lubricant applying member has a shape corresponding to the outer periphery of the lubricant applying member.

7. The lubricant applying device according to claim 1, wherein the solid material is a lubricant.

8. An image forming apparatus, comprising:

an image carrier;

a development unit that forms an image on the image carrier;

a transfer unit that transfers the image formed by the development unit on a printing medium;

a fixing unit that fixes the image transferred by the transfer unit to the printing medium; and the lubricant applying device according to claim 1.

* * * * *